United States Patent [19]

Meyer

[11] 3,949,519

[45] Apr. 13, 1976

[54] TOY GLIDER

[75] Inventor: Burton C. Meyer, Downers Grove, Ill.

[73] Assignee: Marvin Glass & Associates, Chicago, Ill.

[22] Filed: Feb. 14, 1975

[21] Appl. No.: 550,032

[52] U.S. Cl. ..... 46/79

[51] Int. Cl.[2] ..... A63H 27/00

[58] Field of Search ..... 46/75, 79, 80, 81; 244/16

[56] References Cited

UNITED STATES PATENTS

| | | | |
|---|---|---|---|
| 1,927,835 | 9/1933 | Kellogg | 46/79 |
| 2,546,078 | 3/1951 | Rogallo et al. | 244/16 UX |
| 3,204,368 | 9/1965 | Effinger et al. | 46/78 |
| 3,438,597 | 4/1969 | Kasper | 244/16 UX |

*Primary Examiner*—Louis G. Mancene
*Assistant Examiner*—Robert F. Cutting
*Attorney, Agent, or Firm*—Coffee & Sweeney

[57] ABSTRACT

A flexible wing glider including a highly flexible, air impervious diaphragm which is secured to a central longitudinal keel and two rearwardly and outwardly diverging leading edge spars to form a pair of symmetrical, semi-conical wing sections. A payload support for a figure toy or other item is rigidly secured to the central keel and includes a pair of adjustable air foil stabilizers and a depending hook for launching of the glider by resilient means.

17 Claims, 7 Drawing Figures

TOY GLIDER

BACKGROUND OF THE INVENTION

This invention relates to flexible wing gliders and more particularly to a toy device of this type which can be manually launched.

Figure toy accessories have been produced which provide a great amount of participating activity for children. Children are particularly amused and entertained by those types of accessories which enable a figure toy or the like to perform functions which imitate adult activities. In particular, in adventure sets, it is desirable to provide airplanes, vehicles, or the like, in which figure toys imitate adult moving activities.

It is an object of this invention to provide a toy flexible wing glider for use either alone or with figure toys, or other payloads, which is capable of performing the flight characteristics of a full-sized glider, and which can be durably and efficiently produced.

In the preferred embodiment, the flexible wing glider includes a central longitudinal keel and a pair of rearwardly diverging edge spars connected to the front of the keel by a nose piece. An air impervious, flexible diaphragm is connected to the edge spars and the central keel to provide a pair of symmetrical wing portions. A payload support is rigidly secured to the keel for supporting a figure toy during flight. A pair of adjustable air foil stabilizers are mounted on the central keel.

Other objects, features and advantages of the invention will be apparent from the following detailed description taken in connection with the accompanying drawings.

DESCRIPTION OF THE PREFERRED EMBODIMENT

Figure 1:
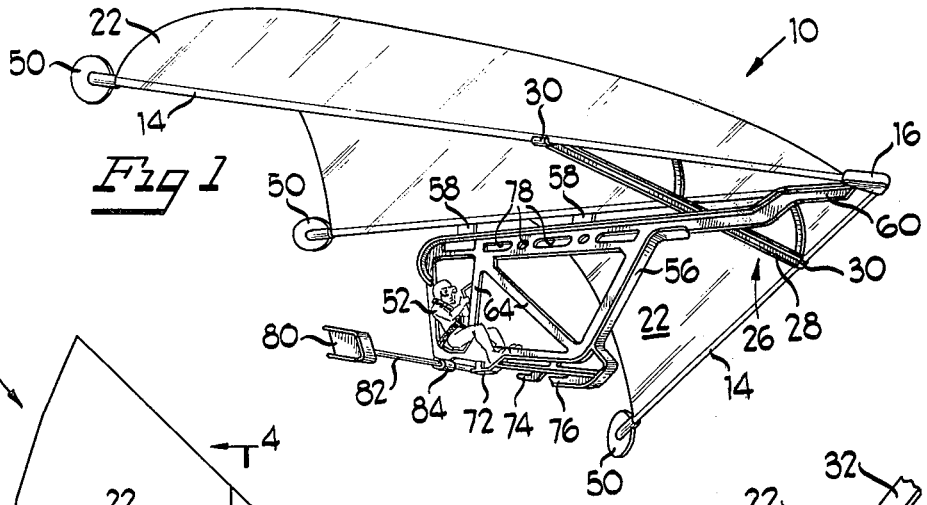
FIG. 1 is a perspective view of the flexible wing glider of the present invention, during flight.
Figure 2:
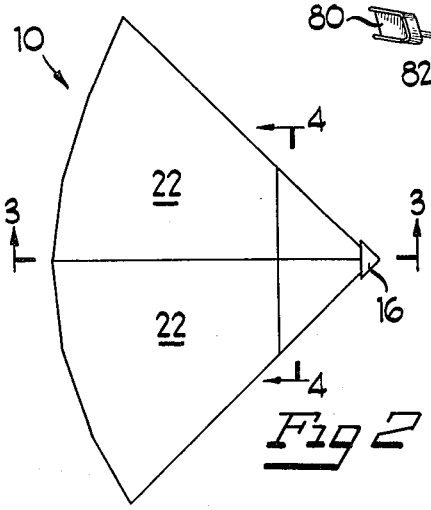
FIG. 2 is a top plan view, on a reduced scale, of the glider of FIG. 1.

The flexible wing glider of the present invention, generally designated 10 (FIG. 1), is of the Rogallo or parawning type, having a central longitudinal keel 12 and two resilient, leading edge spars 14 diverging rearwardly and outwardly from the forward end of the keel 12. The leading edge spars 14 are fastened to the longitudinal keel 12 by a triangular nose piece 16, as can be seen in FIGS. 1 and 2. A triangular, substantially air impervious, flexible diaphragm is fixed to and between the keel 12 and the leading edge spars 14 to form two wings 22. The keel 12 and leading edge spars 14 are substantially rigid and provide longitudinal stiffness, thus allowing the wings 22 to bow upwardly between the edge spars and form semi-conical, aerodynamic lifting surfaces which are maintained in shape by air forces during flight. The specific construction and materials involved will depend on the particular use and performance required. In one form of the embodiment, the keel 12 and ribs 14 are manufactured of plastic and the diaphragm is constructed from No. 400 polyethylene.

Figure 5:
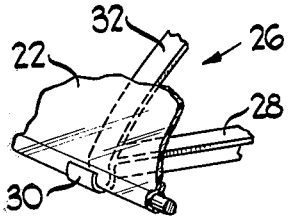
FIG. 5 is a fragmented perspective view of the attachment of the control rib for the air foil stabilizers with one of the leading edge spars.
Figure 4:
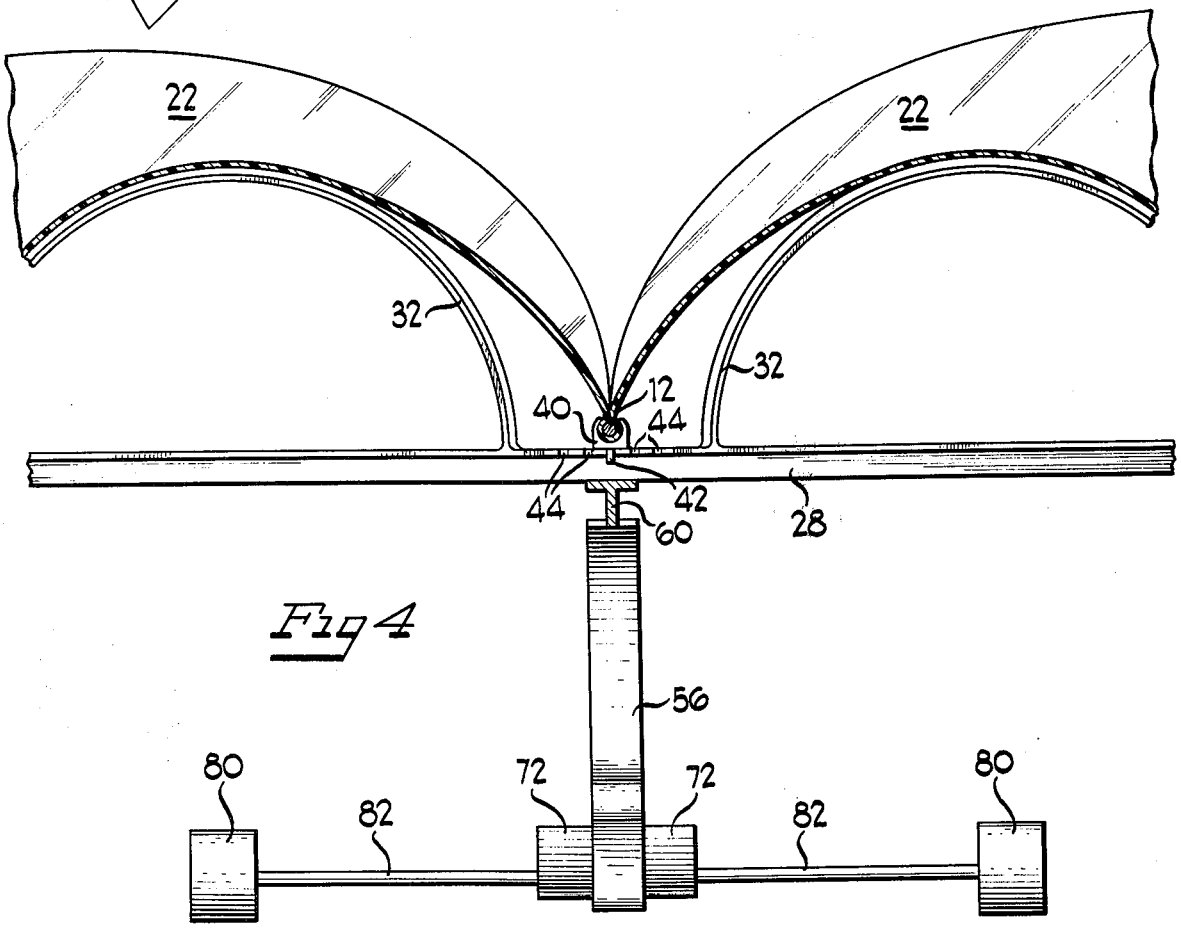
FIG. 4 is a fragmented transverse vertical section of the glider, on an enlarged scale, taken generally along the line 4—4 of FIG. 2.

A flight directional control rib 26 is provided to permit selective predetermined alterations of the path of flight. Referring to FIGS. 1, 4 and 5, the control rib 26 includes a transversely disposed T-shaped beam 28 which is connected at its outermost ends by circular rod clips 30 formed on the ends thereof, to each leading edge spar 14 at points equidistant from the nose piece 16. The control rib 26 also includes two semi-circular, upstanding arcuate ribs 32 which engage the wings 22 giving support thereto.

Figures 3, 6, 7:
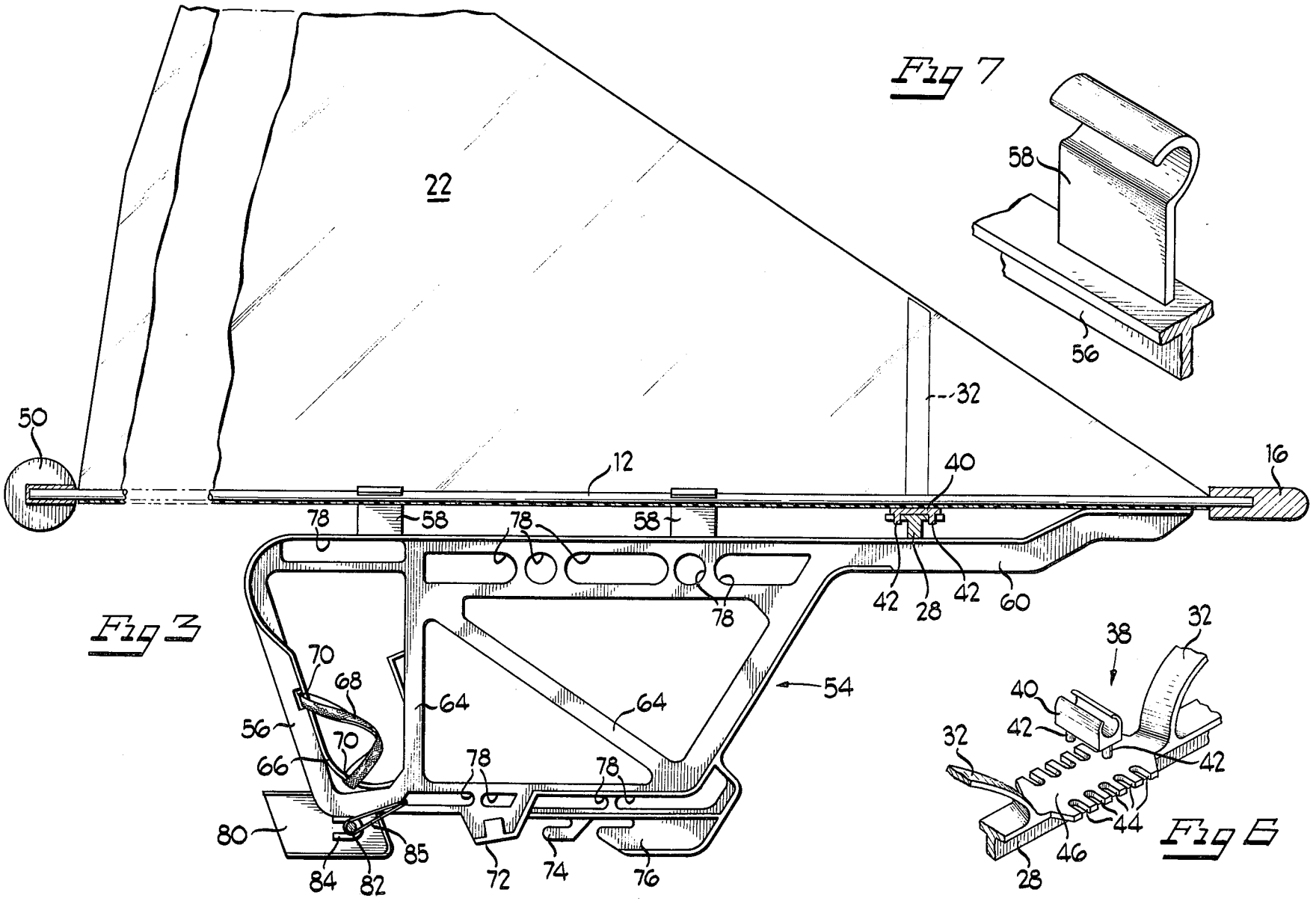
FIG. 3 is a fragmented longitudinal vertical section of the glider, on an enlarged scale, taken generally along the line 3—3 of FIG. 2.
FIG. 6 is a fragmented perspective view, on an enlarged scale, of the selectively adjustable connecting means of the control rib.
FIG. 7 is a perspective view, on an enlarged scale, of the payload support fastening means.

The aforementioned control rib 26 is adjustably attached to the keel 12 so that it can be selectively moved relative thereto in a longitudinal and/or transverse direction. More particularly, referring to FIG. 6, a control rib attachment means, generally designated 38, is shown to include a circular rod clip 40, similar to the clip 30, which will snap onto the keel 12. The clip 40 includes two depending prongs 42 which are adapted to frictionally engage within one of a plurality of pairs of slots 44 formed in an expanded, flattened area 46 of the cross portion of the T-beam 28. This construction permits selective transverse placement of the connecting rib 26 by disengagement and then re-engagement of the prongs 42 in an opposed pair of the slots 44. Transverse movement of the control rib 26 changes the configuration of the wings 22 thus making one larger than the other, which will cause the glider to move in a circular or spiral flight path in the direction of the smaller wing.

The clip 40, in conjunction with the leading edge spar clips 30 also permits sliding of the control rib 26 longitudinally relative to the keel and spars. As the control rib is moved rearwardly from the nose piece 16 the flexible nature of the spars causes them to flex inwardly toward the keel about the nose piece 16. This type of adjustment gives more curvature to the wings 22 and will cause the glider to descent at a faster rate due to the smaller effective air foil surface.

A decorative, circular fin 50 is secured to the trailing end of the keel and each of the spars to aid in directional travel and also to maintain the diaphragm on the keel 12 and spars 14.

A payload support, generally designated 54, is secured to the main keel 12 and depends downwardly therefrom to permit carrying of a suitable payload or figure toy passenger 52 (FIG. 1). More particularly, referring to FIGS. 1 and 3, the payload support 54 is seen to include a generally rectangular frame 56 which is secured by a pair of rod hooks 58 (FIG. 7) to the central keel 12. A forward extension 60 of the frame 56 abuts the underside of the keel 12 immediately behind the nose piece 16 so that the payload support is longitudinally stabilized. In other words, the support cannot pivot about a transverse axis and thereby stabilizes the glider for use as a toy. The frame 56 has a pair of cross struts 64 for adding longitudinal and vertical rigidity to the frame 56. A curved flange portion 66 adjacent the rear lower corner of the support frame 56 provides a seat for a figure toy 52. A belt or rubberband 68 is passed through two apertures 70 in the frame to releasably secure the figure toy 52 on the seat 66. A pair of slanted, outwardly extending foot rests 72 are secured to the bottom portion of the frame 56 to support the legs and feet of the figure toy. Forwardly of the foot rests on the frame 56 are two rearwardly extending depending tongues or hooks 74 and 76 for use with resilient means (not shown) for launching the glider. The frame 56 also includes a plurality of various shaped holes or apertures 78 to decrease the weight of the frame 56 and for construction aesthetics.

A pair of combined air foil landing skids 80 are provided on the support frame 56 to maintain the glider in an upright position when landing. More particularly, referring to FIG. 4, the pair of skids 80 are secured to the support frame 56, outwardly therefrom, by an extended rod 82. The skids 80 thereby additionally aid in controlling the direction of flight of the glider. The shaft 82 is mounted in a U-shaped journal 84 formed in the lowermost rearward end of the frame 56. A rubberband 85 is passed through the lowermost, rearward aperture 78 and looped around the ends of the shaft 82 to hold the shaft within the journal 84.

The glider is launched similar to the projectile of a sling-shot. The resilient means is held in one hand by the user disposed within one of the hooks 74 or 76. The glider is drawn back against the force of the resilient means and then released to launch the glider into the air. Other similar launching means are contemplated.

The foregoing detailed description has been given for clearness of understanding only and no unnecessary limitations should be understood therefrom as some modifications will be obvious to those skilled in the art.

I claim:

1. A toy flexible wing glider, comprising:

a frame including a longitudinal keel member and at least two resilient leading edge spar members disposed one at each side of said keel member;

means connecting said leading edge spar members near the front of said keel member with the spar members diverging rearwardly therefrom;

a diaphragm of substantially air impervious, flexible material secured to said frame forming two semi-conical wing portions when in flight;

a payload support connected to said keel and including means for supporting a figure toy for aerodynamically transporting the figure toy through the air; and selectively adjustable flight direction control means on the frame for varying the relative sizes of the two semi-conical wing portions to change the predetermined path of flight of the glider.

2. A flexible wing glider, comprising:

a frame including a longitudinal keel member and at least two leading edge spar members disposed one at each side of said keel member;

means connecting said leading edge spar members near the front of said keel member with the spar members diverging rearwardly therefrom;

a diaphragm of substantially air impervious, flexible material secured to said frame forming two semi-conical wing portions when in flight;

a payload support connected to said keel and including means for supporting a figure toy for aerodynamically transporting the figure toy through the air; and selectively adjustable flight direction control means on the frame wherein the control means includes a transverse control rib fastened at its outer ends to the leading edge spar members at points equidistant from the nose piece, said control rib being transversely adjustably connected to said keel member whereby selective movement of said control rib transverse to said keel varies the shape of the diaphragm to alter the path of the glider.

3. The toy flexible wing glider as set forth in claim 2 wherein the control rib is connected to the keel by a clip means having longitudinally spaced prongs, said prongs being selectively engageable in one of a plurality of transversely spaced pairs of notches provided on the control rib to alter the relative sizes of the wing portions of the diaphragm.

4. The toy flexible wing glider as set forth in claim 2 wherein the control rib is connected to the keel by means permitting longitudinal movement of the rib relative to the keel so as to vary the curvature, and thereby vary the aerodynamic surface, of the wing portions.

5. The toy flexible wing glider as set forth in claim 4 wherein the control rib is connected to the keel by a clip means having longitudinally spaced prongs, said prongs being selectively engageable with one of a plurality of transversely spaced pairs of notches provided on the control rib to permit alteration of the relative sizes of the wing portions in addition to permitting varying curvature of both of the wing portions.

6. A toy flexible wing glider, comprising:

a frame including a longitudinal keel member and at least two resilient leading edge spar members disposed one at each side of said keel member;

means connecting said leading edge spar members near the front of said keel member with the spar members diverging rearwardly therefrom;

a diaphragm of substantially air impervious, flexible material secured to said frame forming two semi-conical wing portions when in flight; and a payload support connected to said keel and including means for supporting a figure toy for aerodynamically transporting the figure toy through the air including means for longitudinally stabilizing said payload support.

7. A toy flexible wing glider, comprising:

a frame including a longitudinal keel member and at least two resilient leading edge spar members disposed one each side of said keel member;

means connecting said leading edge spar members near the front of said keel member with the spar members diverging rearwardly therefrom;

a diaphragm of substantially air impervious, flexible material secured to said frame forming two semi-conical wing portions when in flight; and a payload support connected to said keel and including means for supporting a figure toy for aerodynamically transporting the figure toy through the air wherein said payload support includes means for removably supporting said figure toy thereon.

8. The toy flexible wing glider of claim 7 wherein said support means comprises a seat for the figure toy and strap means to hold the figure toy on the seat.

9. A toy flexible wing glider, comprising:

a frame including a longitudinal keel member and at least two resilient leading edge spar members disposed one at each side of said keel member;

means connecting said leading edge spar members near the front of said keel member with the spar members diverging rearwardly therefrom;

a diaphragm of substantially air impervious, flexible material secured to said frame forming two semi-conical wing portions when in flight; and a payload support connected to said keel and including means for supporting a figure toy for aerodynamically transporting the figure toy through the air including launching means on the payload support to facilitate initiating a path of flight for the glider.

10. A toy flexible wing glider, comprising:

a longitudinal keel member and at least two leading edge spar members disposed one at each side of said keel member;

means connecting said leading edge spar members near the front of said keel with the spar members diverging rearwardly therefrom;

a diaphragm of substantially air impervious flexible material secured to said keel member and said leading edge spars to form two semi-conical wing portions when in flight;

a payload support member; and selectively adjustable, stabilizing air foil control means on the payload support member whereby the path of flight of the glider may be controlled by adjusting the air foil means.

11. The toy flexible wing glider as set forth in claim 10 wherein the adjustable air foil stabilizer means comprises at least one fin fixedly secured outwardly and transversely from the payload support member.

12. The toy flexible wing glider as set forth in claim 11 including two of said air foil fins, one on either side of said payload support member.

13. The toy flexible wing glider as set forth in claim 12 including launching means on said payload support member for facilitating initiating a path of flight for the glider, in the form of a depending tongue on the payload support member.

14. The toy flexible wing glider as set forth in claim 10 wherein the control means includes a transverse control rib fastened at its outer ends to the leading edge spars at points equidistant from the nose piece, said control rib being transversely adjustably connected to said keel member whereby selective movement of said control rib transverse to said keel varies the shape of the diaphragm to alter the path of flight of the glider.

15. The toy flexible wing glider as set forth in the 14 wherein the control rib is connected to the keel by a clip means having longitudinally spaced prongs, said prongs being selectively engageable in one of a plurality of transversely spaced pairs of notches provided on the control rib to alter the relative sizes of the wing portions of the diaphragm.

16. The toy flexible wing glider of claim 14 wherein the control rib is connected to the keel by means permitting longitudinal movement of the rib relative to the keel so as to vary the curvature, and thereby vary the aerodynamic surface, of the wing portions.

17. The toy flexible wing glider of claim 16 wherein the control rib is connected to the keel by a clip means having longitudinally spaced prongs, said prongs being selectively engageable with one of a plurality of transversely spaced pairs of notches provided on the control rib to permit alteration of the relative sizes of the wing portions in addition to permitting varying curvature of both of the wing portions.

* * * * *